US008811840B2

(12) United States Patent
Suzuki

(10) Patent No.: US 8,811,840 B2
(45) Date of Patent: Aug. 19, 2014

(54) IMAGE FORMING APPARATUS DIRECTING BLOWN AIR TOWARD A SHEET CONVEYING PATH BETWEEN A PAIR OF ROLLERS

(75) Inventor: Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 13/291,270

(22) Filed: Nov. 8, 2011

(65) Prior Publication Data

US 2012/0121286 A1 May 17, 2012

(30) Foreign Application Priority Data

Nov. 16, 2010 (JP) ..... 2010-256251
Oct. 26, 2011 (JP) ..... 2011-235128

(51) Int. Cl.
*G03G 15/20* (2006.01)
*G03G 15/00* (2006.01)

(52) U.S. Cl.
CPC .... *G03G 15/6585* (2013.01); *G03G 2215/0081* (2013.01)
USPC ..... 399/67; 399/92; 399/341

(58) Field of Classification Search
CPC ..... G03G 2215/0081; G03G 2215/0805; G03G 15/6585; G03G 15/6582
USPC ..... 399/67, 94, 341
See application file for complete search history.

(56) References Cited

U.S. PATENT DOCUMENTS

| | | | |
|---|---|---|---|
| 7,242,895 | B2 | 7/2007 | Inada et al. |
| 7,421,237 | B2 | 9/2008 | Funato et al. |
| 7,941,086 | B2 | 5/2011 | Kurita |
| 2008/0181688 | A1 | 7/2008 | Kurita |

FOREIGN PATENT DOCUMENTS

| | | | | |
|---|---|---|---|---|
| JP | 2004-85882 | A | | 3/2004 |
| JP | 2004-198482 | A | | 7/2004 |
| JP | 2006-078816 | A | | 3/2006 |
| JP | 2008-181022 | A | | 8/2008 |
| JP | 2010-054834 | A | | 3/2010 |
| JP | 2010054834 | A | * | 3/2010 |

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes: a switch member that selectively switches a blowing direction of an air drawn by a fan and passing through a duct to a direction toward a conveying roller pair or a direction toward a sheet conveying path between the conveying roller pair and a fixing device; and a control portion that switches the switch member, based on a setting by an operation portion to that a gloss mode for an image to be formed on the sheet is set, so that when a mode for forming a high gloss image is set, the blowing direction of the air is switched to the direction toward the pair of rollers, and when a mode for forming a low gloss image is set, the blowing direction of the air is switched to the direction toward the sheet conveying path.

13 Claims, 7 Drawing Sheets

IMAGE FORMING APPARATUS DIRECTING BLOWN AIR TOWARD A SHEET CONVEYING PATH BETWEEN A PAIR OF ROLLERS

BACKGROUND OF THE INVENTION

1. Field of the Invention

The present invention relates to an image forming apparatus that cools a sheet that has passed through a fixing portion, and specifically relates to an image forming apparatus capable of stably providing an image with a desired gloss level and no gloss unevenness.

2. Description of the Related Art

Conventionally, there are image forming apparatuses such as printers, facsimile machines, copiers and multi-functional machines having functions of these types of machines, and as an example of such image forming apparatuses, there is an image forming apparatus using electrophotography.

In an image forming apparatus using electrophotography, when forming an image on a sheet, an electrostatic latent image is formed on a surface of an image bearing member such as a photosensitive drum by means of a known electrophotographic process, and then, the electrostatic latent image is developed with toner to form a toner image. Next, the toner image is electrostatically transferred onto a sheet such as recording paper directly or via an intermediate transfer member, and the transferred toner image is fixed on the sheet by means of a fixing device. The sheet after passing through the fixing device is nipped and conveyed by, e.g., a conveying roller pair including a driven roller and a conveying roller and ejected to the outside of the apparatus.

In recent years, toner containing, e.g., wax and having an enhanced releasing property from a fixing roller is used. Where toner contains wax, when the toner transferred on a sheet is fused by a fixing device, the wax in the toner is also fused at the same time and thereby interposed between the toner surface and the fixing roller surface, enabling enhancement of the releasing property.

When the toner on the sheet is fused by the fixing device, the wax is precipitated on the surface layer of the toner. Since the wax has a fusing point of around 70° C., which is lower than that of the toner, the wax enters a liquid state on the sheet immediately after passing through the fixing device. Even if the wax enters a liquid state, the wax is subsequently cooled and solidified as a result of, e.g., natural heat dissipation before the sheet is ejected to the outside of the apparatus.

As a method for enhancing the gloss level in an image forming apparatus using wax-contained toner, there is a method in which a sheet is rapidly cooled by means of a cooling device immediately after passing through a fixing device so that wax is solidified before the sheet is nipped by a conveying roller pair coming after the fixing device (see U.S. Pat. No. 7,421,237). As a result of the sheet being rapidly cooled by the rapid cooling device, crystallization of wax is suppressed to enhance the gloss level. In such an image forming apparatus, the conveying roller pair coming after the fixing device is made to be a pair of tubular rollers each having a length larger than the entire width of a sheet to avoid the conveying roller pair from partially nipping the sheet, thereby eliminating gloss unevenness and enhancing the gloss level of the entire surface of the sheet.

Furthermore, as a method for changing the gloss level, there is a method in which a cooling unit for a fixing member is provided in a fixing device to change a controlled temperature of the fixing device, thereby changing the gloss level of the sheet (see Japanese Patent Application Laid-Open No. 2004-085882).

In such a conventional image forming apparatus, while enhancement of the gloss level of the entire surface is often desired in general in the case of, e.g., a photographic image, contrarily an image with a suppressed gloss level is often desired in the case of, e.g., a document image.

In order to provide a low gloss level, it is necessary to gradually cool the sheet to promote crystallization of the wax, thereby suppressing the gloss level. However, such a method requires precise control of the temperature of the sheet, resulting in complexity of the entire apparatus. Furthermore, in the case of the aforementioned method in which a sheet is rapidly cooled to enhance the gloss level of an image, in order to gradually cool the sheet, it is necessary to decrease the speed of conveying the sheet, significantly impairing the productivity of the image forming apparatus.

As stated above, in the case of the method in which the gloss level of a sheet is changed by focusing on the crystallization speed of wax, the gloss level largely changes depending on the surface condition of the sheet when the wax is solidified. In other words, where wax is solidified in a state in which the wax is in contact with, e.g., a roller nip with a flat and smooth surface, the wax surface becomes flat and smooth according to the flat and smooth surface property of the roller, enhancing the gloss level. However, where the wax surface is cooled in an unconstrained state by means of, e.g., air-cooling of the sheet, the wax surface has irregularities subject to the influence of irregularities of the toner and the sheet, resulting in a decrease in the gloss level.

Furthermore, in the case of the method in which a controlled temperature of a fixing device is changed by a cooling unit, the gloss level can be changed by changing the fixing temperature. However, if a low gloss level is provided to a sheet with a large basis weight or an image with a large amount of toner, insufficient fixing of toner may occur because of a decrease in the fixing temperature. Furthermore, toner and wax on a sheet that has just passed through a fixing device are still in a fused state, and thus, neither the influence of the surface property of a conveying roller, nor the influence of a cooled state of the sheet is taken into consideration, reducing the possibility of the occurrence of gloss unevenness. As stated above, the conventional image forming apparatuses have difficulty in stably providing an image with a desired gloss level.

SUMMARY OF THE INVENTION

The present invention has been made in view of the current circumstances, and the present invention provides an image forming apparatus capable of stably providing an image with a desired gloss level and no gloss unevenness.

The present invention provides an image forming apparatus including: a fixing portion that heats a toner image to fix the toner image to a sheet; a pair of rollers that conveys the sheet passed through the fixing portion; a blower unit that blows an air; a switch portion that switches a blowing direction of the air blown by the blower unit to a direction toward the pair of rollers or a direction toward a sheet conveying path between the pair of rollers and the fixing portion; an operation portion to set a gloss mode for an image to be formed on the sheet; and a control portion that controls the switching of the switch portion so that when a mode for forming a high gloss image is selected by the operation portion, the blowing direction of the air is switched to the direction toward the pair of rollers, and when a mode for forming a low gloss image is selected by the operation portion, the blowing direction of the air is switched to the direction toward the sheet conveying path.

As with the present invention, in the case of a mode for providing a high gloss image, a blowing direction of an air is set to a direction toward a roller pair, and in the case of a mode for providing a low gloss image, the blowing direction is set to a direction toward a sheet conveying path, enabling provision of a toner image with a selected gloss level on a sheet.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

Figure 1:
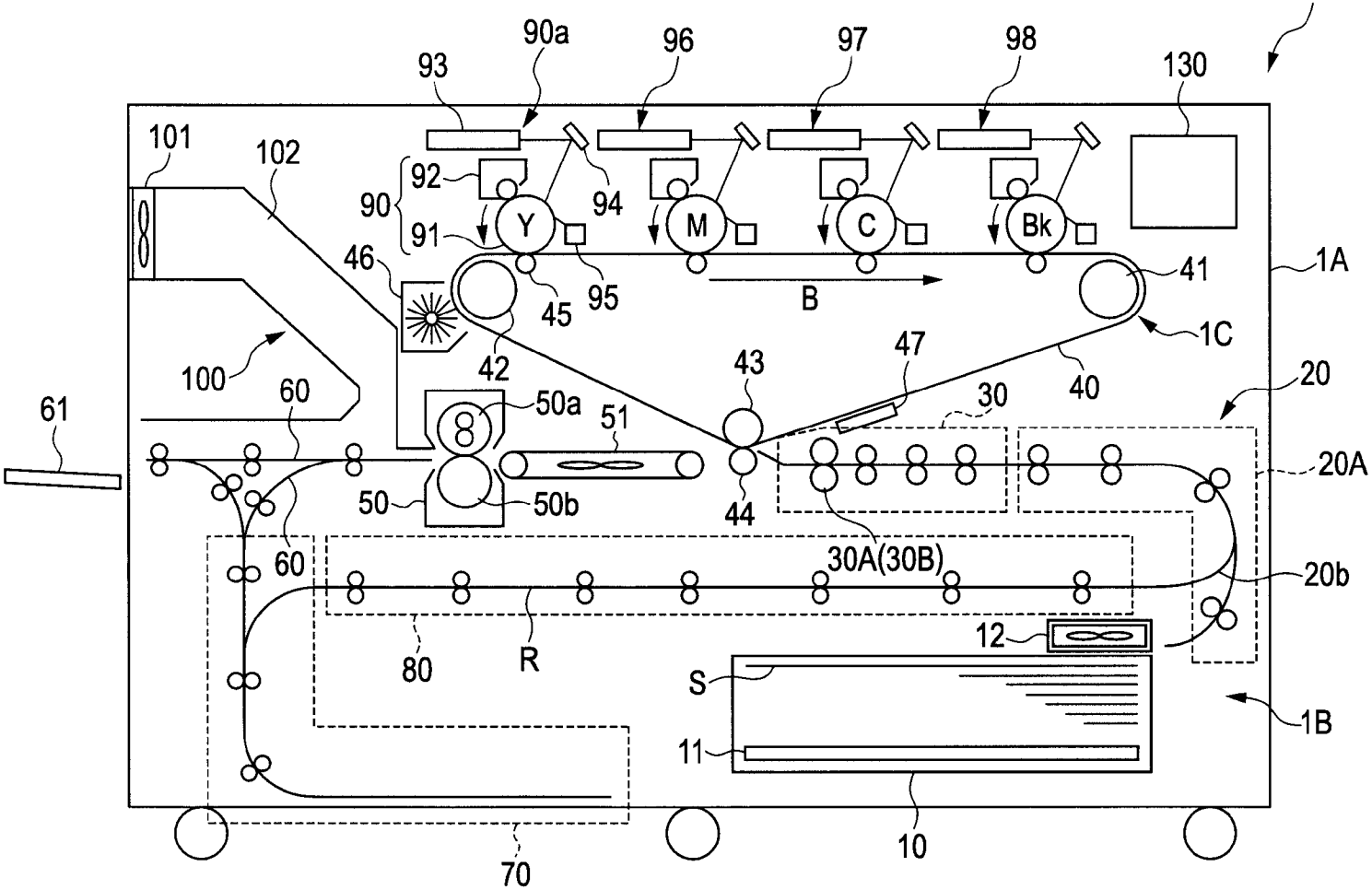
FIG. 1 illustrates a schematic configuration of a color image forming apparatus, which is an example of an image forming apparatus according to a first embodiment of the present invention.

Embodiments of the present invention will be described in detail with reference to the drawings. FIG. 1 illustrates a schematic configuration of a color image forming apparatus, which is an example of an image forming apparatus according to a first embodiment of the present invention. In FIG. 1, a color image forming apparatus main body (hereinafter referred to as "apparatus main body") 1A of a color image forming apparatus 1 includes an image forming portion 90, a sheet feed portion 1B that conveys a sheet S, and a transfer portion 1C that transfers a toner image formed in the image forming portion 90 onto the sheet S fed by the sheet feed portion 1B.

In FIG. 1, a sheet conveying device 20 conveys the sheet S fed by the sheet feed portion 1B to the transfer portion 1C. The sheet conveying device 20 includes a registration unit 30, which is a skew feeding correction device that corrects skew feeding of the sheet S and/or a timing for the sheet S, and a conveying roller portion 20A that conveys the sheet S to the registration unit 30. A controller 130, which is a control portion, controls an image forming operation of the color image forming apparatus 1.

The image forming portion 90 includes four image forming units 90*a*, 96, 97 and 98 for yellow (Y), magenta (M), cyan (C) and black (Bk), respectively. Each of the image forming units 90*a*, 96, 97 and 98 includes, e.g., a photosensitive drum 91, which is an image bearing member, an exposure device 93, a development device 92, a primary transfer device 45 and a photosensitive member cleaner 95. The color image forming apparatus 1 according to the first embodiment employs a tandem intermediate transfer method in which the four-color image forming units 90*a*, 96, 97 and 98 are aligned on an intermediate transfer belt (described later) as the image forming portion. Colors provided by the image forming units 90*a*, 96, 97 and 98 are not limited to the aforementioned four colors, and the arrangement order of the colors is not limited only to the aforementioned one.

The sheet feed portion 1B includes a paper feed cassette 10, which is a sheet storage portion that stores sheets S in such a manner that the sheets S are stacked on a lifter 11 and can be pulled out, and an air paper feeding portion 12 that sucks a sheet S stored in the paper feed cassette 10 and sends the sheet S out. Although in the first embodiment, the sheet feed portion 1B employs air paper feeding in which a sheet is sucked using air and sent, the sheet feed portion 1B can employ a configuration in which a sheet is fed using a sheet feed roller.

The transfer portion 1C includes an intermediate transfer belt 40, which is an image bearing member that is looped around a drive roller 42, a tension roller 41 and an inner secondary-transfer roller 43 and driven in the direction indicated by arrow B in the figure for conveying. Toner images formed on the respective photosensitive drums are transferred onto the intermediate transfer belt 40 by means of predetermined pressure and electrostatic load bias applied by respective primary transfer devices 45. Furthermore, the intermediate transfer belt 40 makes an unfixed image adhere to the sheet S by applying predetermined pressure and an electrostatic load bias in a secondary transfer portion including the inner secondary-transfer roller 43 and an outer secondary-transfer roller 44, which substantially face each other. A patch detection sensor 47 is provided upstream of the inner secondary-transfer roller 43, and detects color displacement in the toner image resulting from transfer of the multiple toner images and a position of a leading edge of the toner image. A cleaner 46 is provided downstream of the inner secondary-transfer roller 43, and collects toner remaining on the intermediate transfer belt 40.

When an image is formed in the color image forming apparatus 1 configured as described above, first, a surface of each photosensitive drum 91 is uniformly charged in advance by means of a non-illustrated charge device. Subsequently, image data is received by the controller 130 and transmitted to the respective exposure device 93. Consequently, the exposure device 93 emits light toward the corresponding photosensitive drum 91 that rotates in the direction indicated by the arrow, based on a signal of received image information, and the light is reflected by a reflective mirror 94 so that the light irradiates the surface of the photosensitive drum, whereby a latent image is formed on the surface of the photosensitive drum.

Next, the electrostatic latent image formed on the respective photosensitive drum 91 is subjected to toner development by the corresponding development device 92, whereby a toner image is formed on the photosensitive drum. Subsequently, predetermined pressure and electrostatic load bias are applied by means of the corresponding primary transfer device 45, whereby the toner image on the respective photosensitive drum 91 (image bearing member) is transferred onto the intermediate transfer belt 40. A slight amount of transfer residual toner on the respective photosensitive drum 91 is collected by the corresponding photosensitive member cleaner 95, and reserved for next image forming.

The image formation of each of the image forming units 90*a*, 96, 97 and 98 for Y, M, C and Bk in the image forming portion 90 is performed at a timing when the toner image is superimposed on an upstream toner image primary transferred on the intermediate transfer belt. As a result, a full-color toner image is finally formed on the intermediate transfer belt 40. A sheet S is sent out from the paper feed cassette 10 by means of the air paper feeding portion 12 according to the timing of the image formation by the image forming portion 90, and subsequently, the sheet S is conveyed to the registration unit 30 through the conveying roller portion 20A.

After the sheet S is subjected to skew feeding correction and/or timing correction in the registration unit 30, the sheet S is conveyed to the secondary transfer portion including the inner secondary-transfer roller 43 and the outer secondary-transfer roller 44, which substantially face each other. Subsequently, predetermined pressure and electrostatic load bias are applied in the secondary transfer portion, whereby the full-color toner image on the intermediate transfer belt 40 (on the image bearing member) is secondary transferred onto the sheet S. Toner remaining without being transferred by the outer secondary-transfer roller 44 is collected by the cleaner 46.

Next, the sheet S onto which the toner image is secondary transferred is conveyed to a fixing device 50, which is a fixing portion in which a toner image transferred on a sheet is fixed, by means of a pre-fixing conveying portion 51. In the fixing device 50, the toner is fused and fixed to the sheet S by means of application of a predetermined pressure via, e.g., rollers substantially facing each other or a belt, plus, in general, application of heat via a heat source such as a heater. In the first embodiment, the fixing device 50 includes a fixing roller 50*a* including a heat source such as a heater inside and a pressure roller 50*b*.

Next, the resulting sheet S with the fixed image formed thereon is conveyed to a branch conveying device 60 by means of a conveying roller pair 110 including a conveying roller 110*b* and a driven roller 110*a*, and directly ejected onto an output tray 61 by means of the branch conveying device 60. Where an image is formed on each of two surfaces of the sheet S, the sheet S is subsequently conveyed to a reverse conveying device 70 by means of switching a non-illustrated switch member. Upon being conveyed to the reverse conveying device 70, a top and a bottom of the sheet S are counter-changed by means of a switchback operation and conveyed to a re-conveying path R provided in a duplex conveying device 80. Subsequently, the sheet S is synchronized with the timing for feeding a sheet for a subsequent job which is conveyed from the sheet feed portion 1B, and joins from a re-feed path 20*b* included in the sheet conveying device 20. The sheet S is then sent to the secondary transfer portion as well. The image forming process is similar to that of the first surface and thus, a description thereof will be omitted.

Since, in general, the above-described fixing device 50 is controlled to maintain a temperature of around 180° C. to fuse toner, toner on a sheet immediately after passing through the fixing device 50 is still in a fused state. Toner contains wax so as to enhance the releasing property from the fixing roller 50*a*, however the wax has a fusing point of around 70° C., and thus, the wax is also still in a fused state immediately after the fixing.

Figure 8:
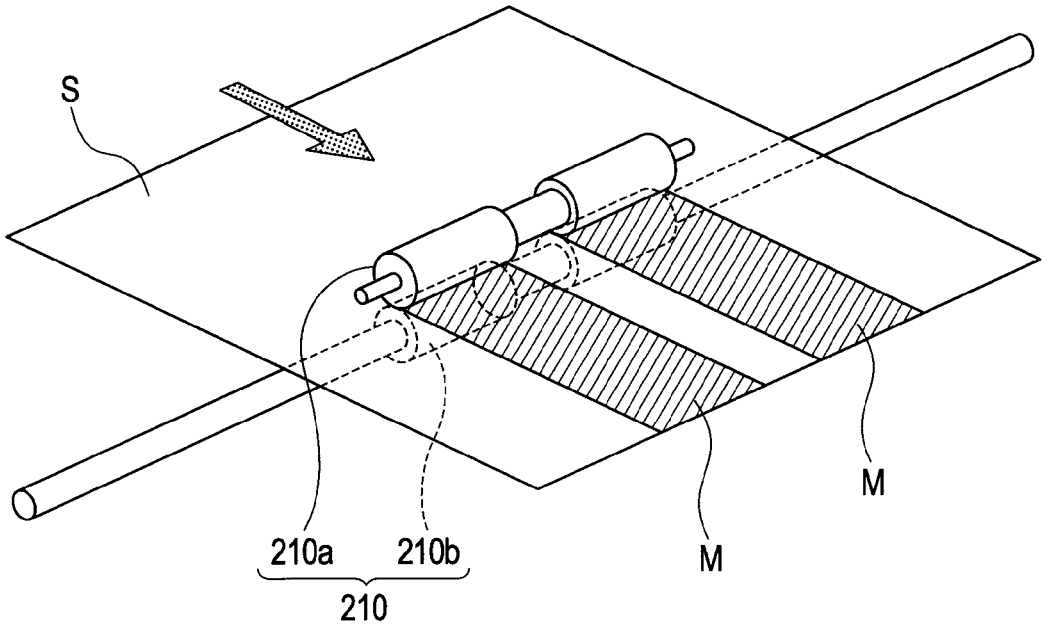
FIG. 8 illustrates a problem of a conventional image forming apparatus.

When the sheet S is conveyed in such a state by means of the aforementioned conveying roller pair 210 illustrated in FIG. 8, whose length in the width direction orthogonal to the sheet conveying direction is shorter than the length in the width of the sheet S, the cooling of the wax is promoted at a part of the sheet S that is in contact with the conveying roller 210*b* or the driven roller 210*a*. Thus, a gloss-level difference, i.e., what is called a roller mark or a driven roller mark M, is generated between a part of the sheet S nipped by the conveying roller pair 210 and a part of the sheet S not nipped by the conveying roller pair 210.

Figure 2A:
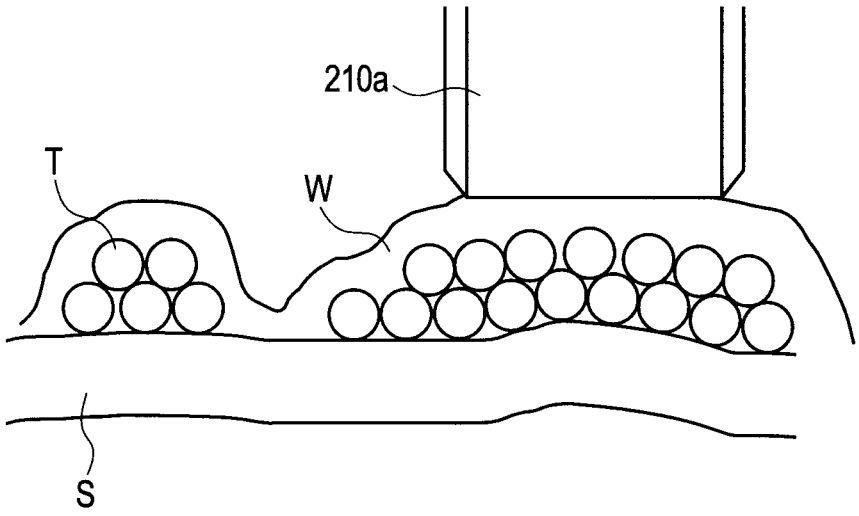
FIGS. 2A and 2B each illustrate toner and wax in a fused state.

As already described, wax on a surface on a part of a sheet nipped by a conveying roller pair 210 such as illustrated in FIG. 8 becomes flat and smooth compared to that on a part of the sheet not nipped by the conveying roller pair 210 according to the surface property of the driven roller 210*a* as illustrated in FIG. 2A, resulting in the wax entering a high gloss state.

In order to avoid the occurrence of such a roller mark or driven roller mark M, there is a method in which each of conveying roller pairs conveying a sheet and coming after the fixing device is made to be a pair of tubular rollers each having a length larger than the width of the sheet. In such a method, wax W on the sheet is cooled by the conveying roller pairs in a state in which the entire width of the sheet is nipped by the conveying roller pairs, resulting in enhancement of the gloss level of the entire sheet.

Figure 2B:
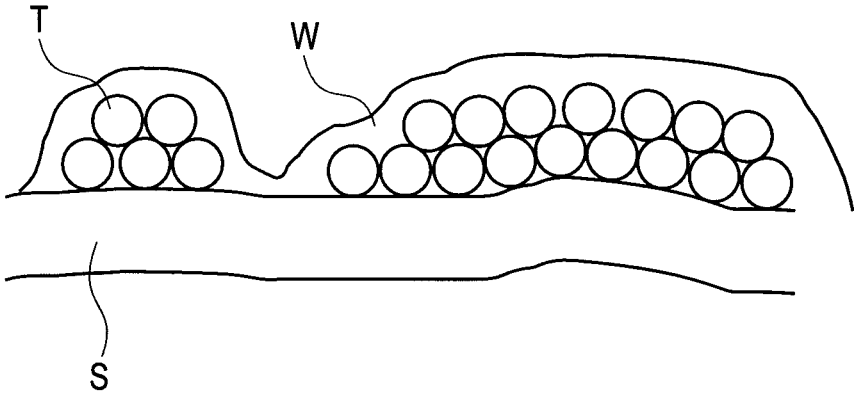

As already described, there is a method in which a sheet is rapidly cooled immediately after passing through the fixing device and before being conveyed to a conveying roller pair to solidify wax W on the sheet. In such a method, as illustrated in FIG. 2B, wax W on a sheet S is solidified with its surface exposed, and thus, enters a state following irregularities of toner T and the sheet S, resulting in a decrease in the gloss level of the entire sheet.

As already described, color products output from the color image forming apparatus 1 include images desired to have a relatively high gloss level such as photographic images, and images desired to have a relatively low gloss level such as document images. The gloss level of a product may vary depending not on the image but the taste of the user. Thus, it is desirable that in the color image forming apparatus 1, the gloss level can be selected in order to provide an image with a desired gloss level.

Figure 3:
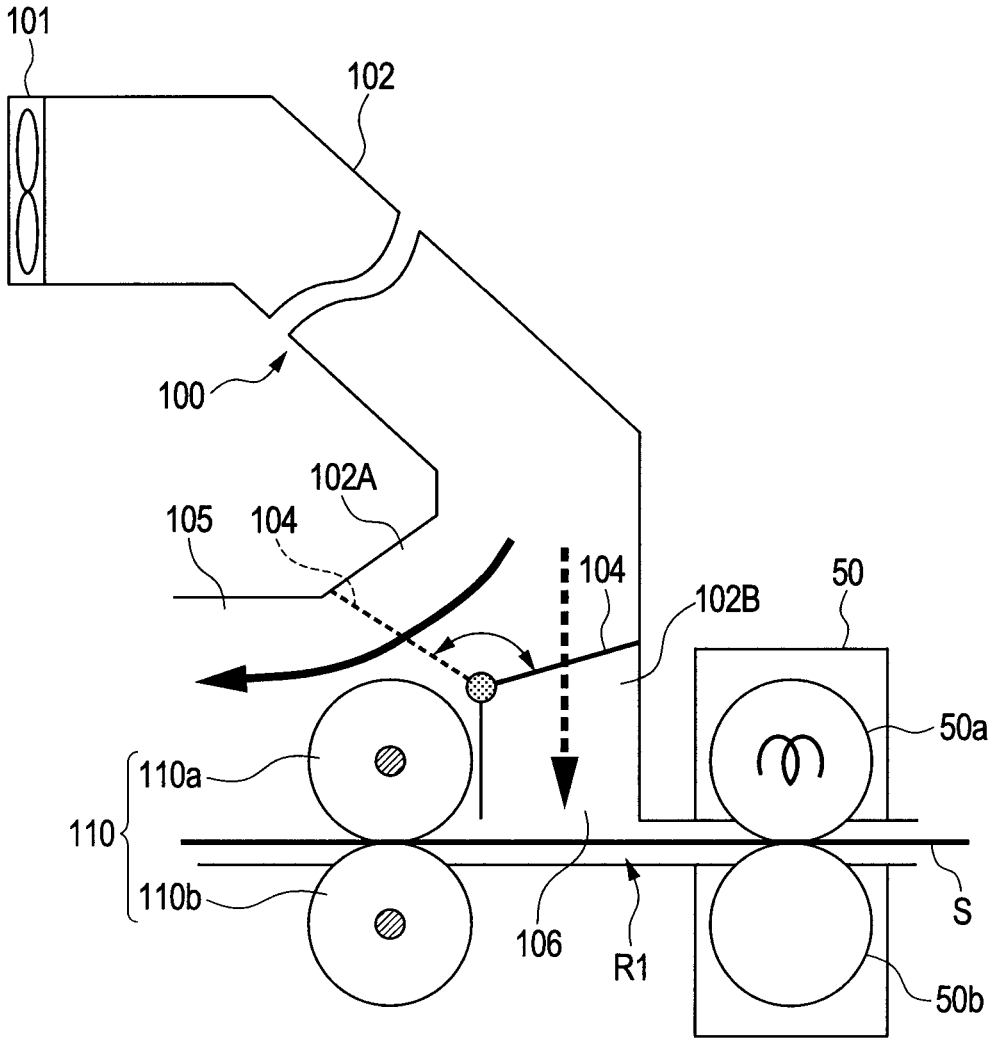
FIG. 3 illustrates a configuration of a sheet cooling device provided in the color image forming apparatus.

In order to eliminate gloss unevenness of a sheet and provide an image with a desired gloss level, in the first embodiment, as illustrated in FIG. 1, a sheet cooling device 100 for cooling a sheet at a position close to downstream in the sheet conveying direction of the fixing device 50 is provided. As illustrated in FIG. 3, the sheet cooling device 100 is installed near an exterior portion of the apparatus main body, and includes a fan 101, which is a blower unit that blows an air, and a duct 102 that allows the air blown by the fan 101 to pass through.

At an end on the downstream side of the duct 102, a first exhaust passage 102A that directs the air toward the conveying roller pair 110, and a second exhaust passage 102B that directs the air toward a sheet conveying path R1 between the conveying roller pair 110 and the fixing device 50 are provided. The sheet cooling device 100 includes a switch member 104 that selectively switches the direction of the air blown by the fan 101 to the direction toward the driven roller 110*a* (conveying roller pair) or the direction toward the sheet conveying path R1.

The switch member 104 is driven by a solenoid 506 illustrated in FIG. 5, which will be described later. The direction of the air is switched to the direction toward the driven roller 110*a* by means of the switch member 104, enabling the driven roller 110*a* to be cooled by the air. In the first embodiment, a switch portion, that switches the blowing direction of the air passing through the duct 102 to the direction toward the conveying roller pair or to the direction toward the sheet conveying path, includes the switch member 104 and the solenoid 506.

Figure 4:
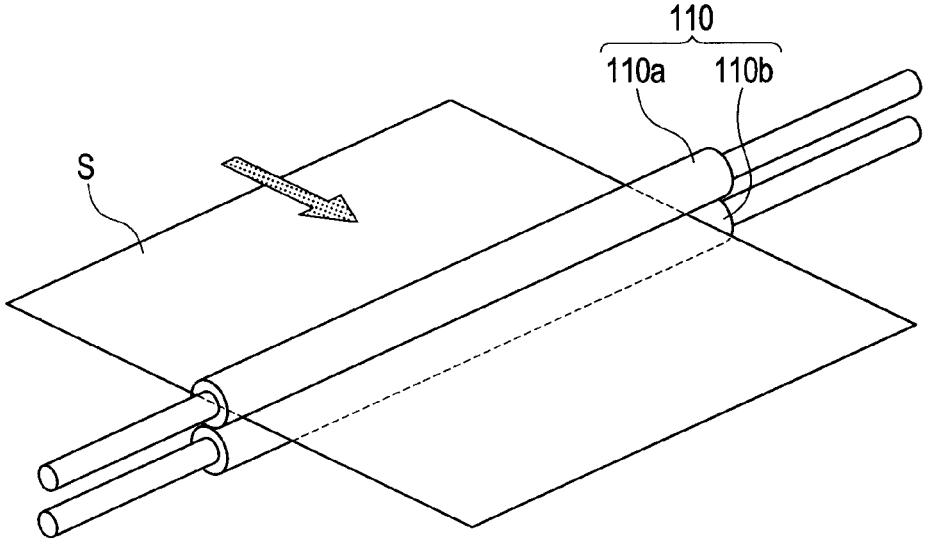
FIG. 4 illustrates a configuration of sheet conveying rollers provided in the sheet cooling device.

In the first embodiment, as illustrated in FIG. 4, the conveying roller 110*b* and the driven roller 110*a* included in the conveying roller pair 110 each have a tubular shape having a length in a width direction larger than a width of a maximum size of sheet that can be conveyed. The surfaces of the roller and the driven roller each have a flat and smooth surface property for flattening and smoothing the surface property of the wax on the sheet S. For efficiently removing heat from the sheet S, the driven roller 110*a* can include a material with high heat conductivity such as a metal material. Furthermore, for provision of the high surface property to enhance the releasing property from toner and wax, a fluorinated coating or tube may be used for the surface of the driven roller.

As a result of the surface of the driven roller 110*a*, which is a cooling member that rotates in contact with the sheet S, being cooled by the air blown by the fan 101, the wax on the sheet S can uniformly be cooled in a short period of time, that is, can rapidly be cooled. After cooling the driven roller 110*a*, the air illustrated in FIG. 3 is discharged from an air outlet port 105.

The direction of the air is switched to the direction toward the sheet conveying path by means of the switch member 104, whereby the air blows out from an air outlet port 106 toward the sheet conveying path R1, enabling cooling of the surface of the sheet S passing through the conveying path R1. Switching the position of the switch member 104 provided in the duct 102 enables the direction of the air blown by the fan 101 to be arbitrarily switched to the direction toward the driven roller 110*a* or the direction toward the sheet conveying path. Consequently, the sheet S with the toner fused and fixed thereto by the fixing device 50 can be cooled by the air to a predetermined temperature at which the toner and the wax contained in the toner are solidified, directly or via the driven roller 110*a* in the sheet cooling device 100.

Figure 5:
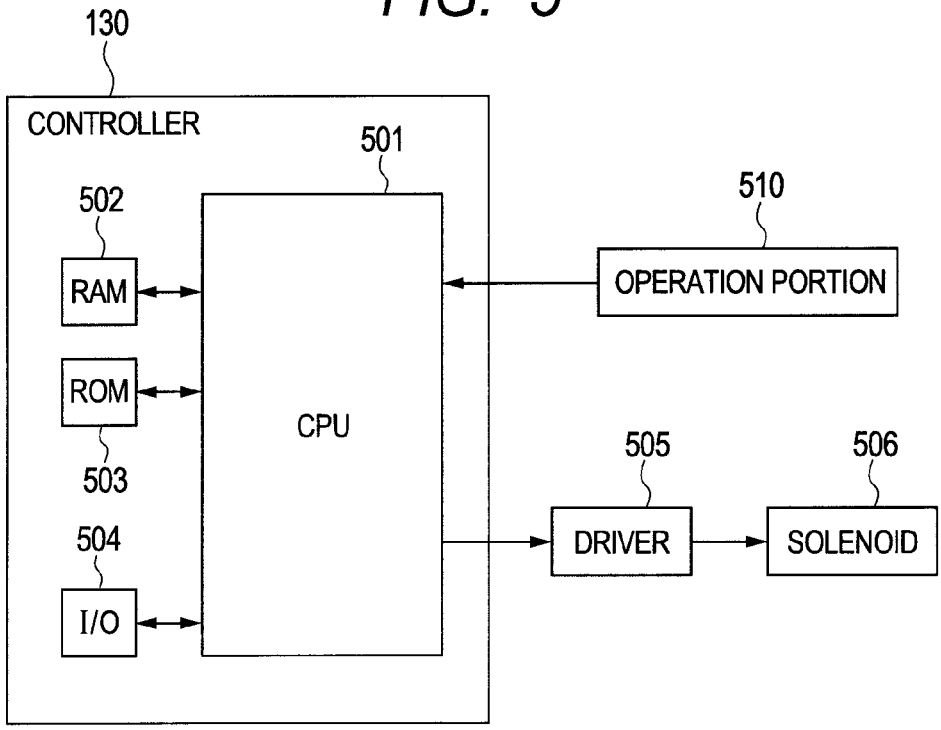
FIG. 5 is a block diagram of control performed in the color image forming apparatus.

FIG. 5 is a block diagram of control performed in the color image forming apparatus 1 according to the first embodiment. The controller 130 includes a CPU 501, a ROM 503 for storing programs, a RAM 502 for temporally storing data, and a communication I/O interface 504. An operation portion 510 to which a high gloss mode or a low gloss mode is selectively set as a gloss mode for a toner image to be formed on a sheet, and a driver 505 that drives the solenoid 506 are connected to the controller 130.

Figure 6:
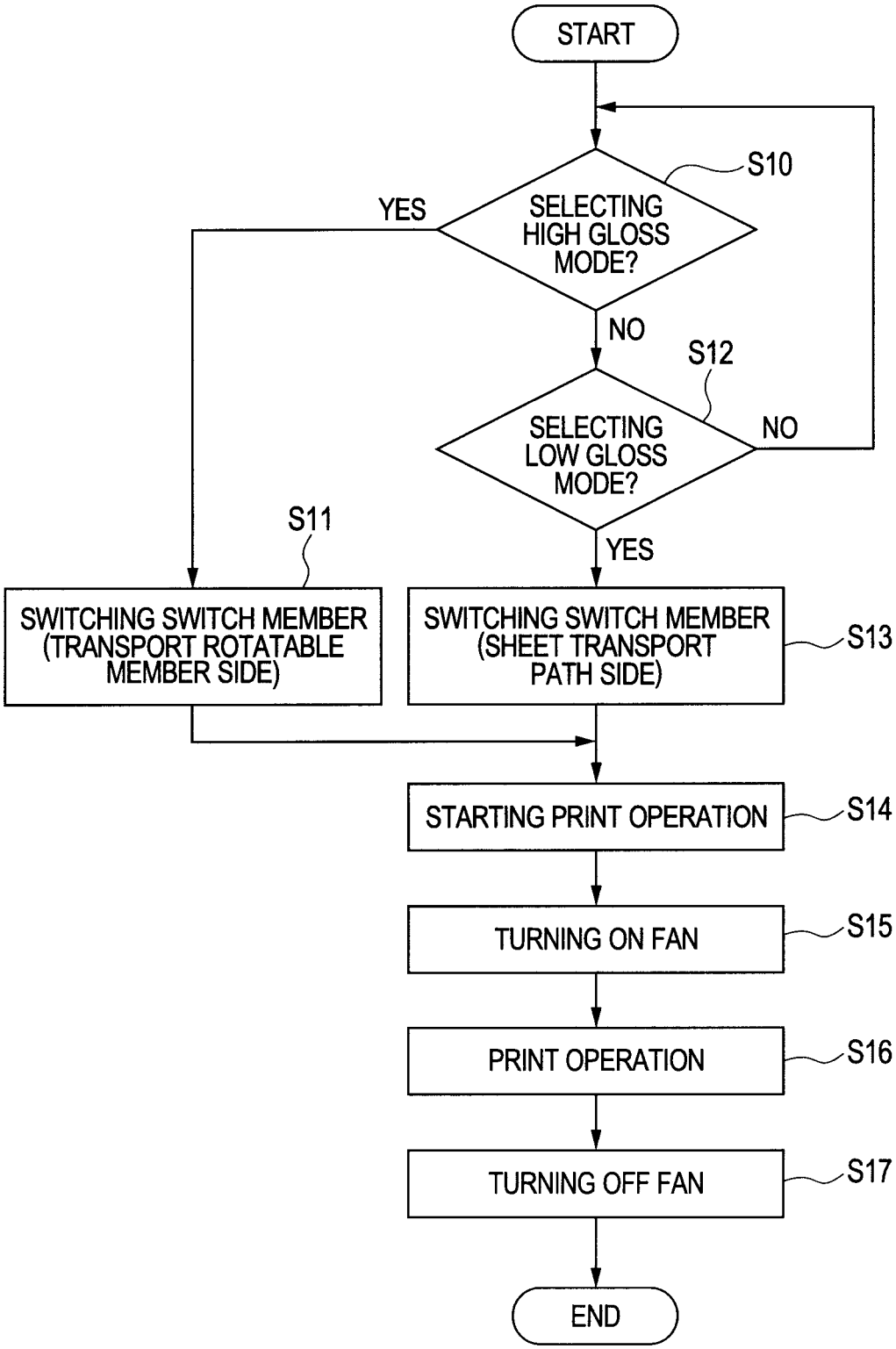
FIG. 6 is a flowchart illustrating control for a sheet cooling operation of the sheet cooling device.

An operation of cooling a sheet (toner image) by means of the sheet cooling device 100 configured as described above will be described with reference to the flowchart illustrated in FIG. 6.

A user selects the high gloss mode or the low gloss mode via the operation portion 510. If the user selects the high gloss mode (Y in S10), the CPU 501 in the controller 130 drives the solenoid 506 via the driver 505 to switch the position of the switch member 104 so as to form an air passage toward the driven roller 110*a*, which is indicated by the solid line in FIG. 3 (S11). In other words, if the user selects the high gloss mode, the position of the switch member 104 is switched to a first position where the switch member blocks the second exhaust passage 102B and air flows into the first exhaust passage 102A.

If the user does not select the high gloss mode (N in S10) but selects the low gloss mode (Y in S12), the CPU 501 drives the solenoid 506 via the driver 505 to switch the position of the switch member 104 so as to form an air passage toward the sheet conveying path, which is indicated by the dashed line in FIG. 3 (S13). In other words, if the user selects the low gloss mode, the position of the switch member 104 is switched to a second position where the switch member blocks the first exhaust passage 102A and air flows into the second exhaust passage 102B.

After the above-described mode selection, a print operation is started (S14). When a print operation is started, first, the fan 101 is driven (turned on) (S15), whereby air is blown into the duct 102. Subsequently, an image formation (print) operation is started (S16). Consequently, as described above, a toner image is transferred onto a sheet, and the sheet with the toner image transferred thereto is subjected to heat and pressure application in the fixing device 50, whereby the toner image is fixed to the sheet.

Next, the sheet that has passed through the fixing device 50 is conveyed by the conveying roller pair 110. Then, when the sheet is nipped and conveyed by the conveying roller pair 110, if the high gloss mode is selected, the sheet is cooled to a temperature equal to or lower than a solidification temperature of the wax by (the driven roller 110*a* in) the conveying roller pair 110 cooled by the air, whereby the gloss level of the sheet is enhanced. Depending on the surface property of the driven roller, the surface property of the sheet is enhanced and the gloss level of the sheet is thus enhanced. When conveying the sheet that has passed through the fixing device 50, the driven roller 110*a* is heated by heat from the sheet S, however, the driven roller 110*a* is cooled by the air from the fan 101, and thus, can convey the sheet while consecutively cooling the sheet.

When the low gloss mode is selected, the sheet S is directly air-cooled by the air blowing out from the duct 102 toward the sheet conveying path R1. Thus, as illustrated in FIG. 2B, which has already been described, the wax is solidified with its surface exposed and follows irregularities of the toner and/or the sheet, and the gloss level of the entire sheet is deceased. Then, simultaneously with the completion of the image forming (print) operation, the fan 101 is stopped (turned off) (S17).

In the first embodiment, in an initial state before start of an image forming operation, the switch member 104 is set so as to form an air passage toward the driven roller 110*a*, which is illustrated in FIG. 3. This is because a color image forming apparatus 1 such as the color image forming apparatus according to the first embodiment is assumed to relatively often deal with photographic images. Where images of characters are relatively often dealt with as with a monochrome image forming apparatus, the switch member 104 may be set so as to form an air passage toward the sheet conveying path, which is opposite to that of the first embodiment. The initial state may arbitrarily be set by a user, which enhances the user operability.

As described above, in the first embodiment, in the case of a mode for providing a high gloss image, the blowing direction of an air is set to the direction toward the conveying roller pair 110, and in the case of a mode for providing a low gloss image, the blowing direction of the air is set to the direction toward the sheet conveying path R1. Consequently, a toner image with no gloss unevenness and a selected gloss level can be formed on a sheet.

Next, a second embodiment of the present invention will be described.

Figure 7A:
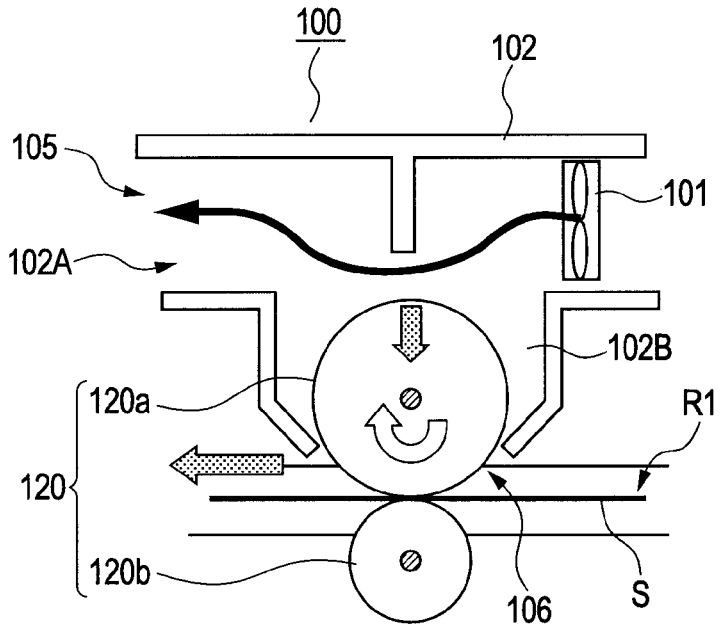
FIGS. 7A and 7B each illustrate a configuration of a sheet cooling device provided in an image forming apparatus according to a second embodiment of the present invention.
Figure 7B:
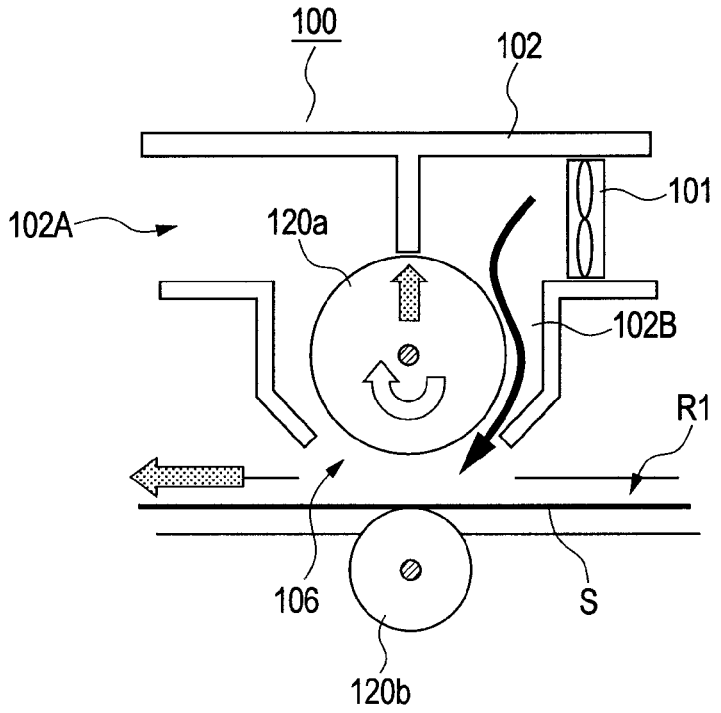

FIGS. 7A and 7B illustrate a configuration of a sheet cooling device in an image forming apparatus according to the second embodiment. In FIGS. 7A and 7B, reference numerals that are the same as those in FIG. 4, which has already been described above, denote components that are the same as or correspond to those in FIG. 4. In FIGS. 7A and 7B, a conveying roller pair 120 includes a conveying roller 120*b* and a driven roller 120*a*, which can be brought into contact with/ spaced from each other. In the second embodiment, the driven roller 120*a*, which is one of rollers included in the conveying roller pair 120, can move vertically, and the driven roller 120*a* is spaced from the conveying roller 120*b* by moving the driven roller 120*a* upward. In the second embodiment, the distance between conveying roller pairs which are respectively located upstream and downstream in the conveying direction of the conveying roller pair 120 adjacent to the conveying roller pair 120 is shorter than the length in the conveying direction of a sheet with a smallest size for enabling to pass a sheet. Thus, even though one of the rollers included in the conveying roller pair 120 is spaced from the other roller, a sheet can be conveyed.

FIG. 7A illustrates a state in which the driven roller 120*a* moves downward and comes into contact with the conveying roller 120*b*. In this state, the driven roller 120*a* opens a first exhaust passage 102A and occludes an air outlet port 106 of a second exhaust passage 102B. As a result of the air outlet port 106 being occluded, air blown by a fan 101 cools the surface of the driven roller 120*a* while passing by the upper surface of the driven roller 120*a* and is discharged from an air outlet port 105.

FIG. 7B illustrates a state in which the driven roller 120*a* moves upward and is thereby spaced from the conveying roller 120*b*. In this state, the driven roller 120*a* closes the first exhaust passage 102A and releases the air outlet port 106 of the second exhaust passage 102B. As a result of the air outlet port 106 being released, the air blows onto a surface of the sheet S, and the sheet S is thereby cooled.

In the second embodiment, if a user selects a high gloss mode, as illustrated in FIG. 7A, the first exhaust passage 102A is opened and the air outlet port 106 is occluded, by means of the driven roller 120*a*. Consequently, the sheet is cooled to a temperature equal to or lower than a solidification temperature of wax by (the driven roller 120*a* in) the conveying roller pair 120 cooled by the air, enhancing the gloss level of the sheet S.

If a user selects a low gloss mode, as illustrated in FIG. 7B, the driven roller 120*a* is spaced from the conveying roller 120*b*, the first exhaust passage 102A is closed and the air outlet port 106 is opened. Consequently, a sheet S is cooled by an air blown out from the air outlet port 106 toward a sheet conveying path R1. Here, the sheet is directly air-cooled by the air, and thus, the surface of the wax is solidified in a state in which the surface follows irregularities of toner or the sheet, lowering the gloss level of the entire surface of the sheet.

In the second embodiment, the driven roller 120*a* can be brought into contact with/spaced from the conveying roller 120*b* to change the blowing direction of the air, enabling the provision of an effect similar to that of the first embodiment that has already been described. Although in the second embodiment, the driven roller 120*a* can move vertically, a part on the sheet conveying path side of a duct 102 may be made to move vertically. In other words, an effect similar to that of the above-described first embodiment can be provided by making an end part on the downstream side of the duct 102 move vertically relative to the driven roller 120*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-256251, filed Nov. 16, 2010, and 2011-235128, filed Oct. 26, 2011, which are hereby incorporated by reference herein in their entirety.

What is claimed is:

1. An image forming apparatus comprising:

a fixing portion that heats a toner image formed on a sheet to fix the toner image for forming an image;

a pair of rollers that conveys the sheet passed through the fixing portion, one roller of the pair of rollers being configured to be brought into contact with and spaced from another roller of the pair of rollers;

a blower unit that blows air;

a switch portion that directs the air blown by the blower unit toward the one roller of the pair of rollers by bringing the one roller into contact with the other roller, or toward a sheet conveying path between the pair of rollers and the fixing portion by spacing the one roller from the other roller; and a control portion that controls the switching of the switch portion so that when a mode for forming a first gloss image is set, the one roller is brought into contact with the other roller, and when a mode for forming a second gloss image having a lower gloss than the first gloss image is set, the one roller is spaced from the other roller.

2. The image forming apparatus according to claim 1, further comprising:

an operation portion configured to set the mode for forming the first gloss image and the mode for forming the second gloss image;

a first exhaust passage that directs the air to the pair of rollers; and a second exhaust passage that directs the air to the sheet conveying path, wherein the control portion switches the switch portion so as to selectively direct the air to the first exhaust passage or the second exhaust passage based on the setting by the operation portion.

3. The image forming apparatus according to claim 1, wherein the blown air cools the sheet to a temperature lower than a fusing point of wax that is contained in toner forming the toner image, the wax having a fusing point lower than that of the toner.

4. The image forming apparatus according to claim 1, wherein at least one of the pair of rollers is formed of a metal material.

5. The image forming apparatus according to claim 1, further comprising an operation portion for setting a gloss mode for the image to be formed on the sheet.

6. The image forming apparatus according to claim 1, wherein the length of the pair of rollers in a width direction orthogonal to a sheet conveying direction is larger than the length in the width direction of a maximum size of a sheet which can be conveyed.

7. The image forming apparatus according to claim 1, further comprising a second pair of rollers that convey the sheet, wherein the one roller and the another roller of the pair of rollers are upstream rollers and the second pair of rollers are downstream rollers downstream of the upstream rollers, and wherein the distance between the upstream rollers and the downstream rollers is shorter than the length in a conveying direction of a smallest size of a sheet which can be conveyed.

8. An image forming apparatus comprising:

a fixing portion that heats a toner image formed on a sheet to fix the toner image for forming an image;

a pair of rollers that conveys the sheet passed through the fixing portion, one roller of the pair of rollers being configured to be brought into contact with and spaced from another roller of the pair of rollers;

a blower unit that blows air; and a switch portion that directs the air blown by the blower unit toward the one roller of the pair of rollers by bringing the one roller into contact with the other roller, and that directs the air blown by the blower unit toward a sheet conveying path between the pair of rollers and the fixing portion by spacing the one roller from the other roller.

9. The image forming apparatus according to claim 8, further comprising:

a first exhaust passage that directs the air to the pair of rollers;

a second exhaust passage that directs the air to the sheet conveying path; and a control portion that controls the switching of the switch portion so as to selectively direct the air to the first exhaust passage or the second exhaust passage.

10. The image forming apparatus according to claim 8, wherein the blown air cools the sheet to a temperature lower than a fusing point of wax which is contained in toner forming the toner image, the wax having the fusing point lower than that of the toner.

11. The image forming apparatus according to claim 8, wherein at least one of the pair of rollers is formed of a metal material.

12. The image forming apparatus according to claim 8, wherein the length of the pair of rollers in a width direction orthogonal to a sheet conveying direction is larger than the length in the width direction of a maximum size of a sheet which can be conveyed.

13. The image forming apparatus according to claim 8, further comprising a second pair of rollers that convey the sheet, wherein the one roller and the another roller of the pair of rollers are upstream rollers and the second pair of rollers are downstream rollers downstream of the upstream rollers, and wherein the distance between the upstream rollers and the downstream rollers is shorter than the length in a conveying direction of a smallest size of a sheet which can be conveyed.

* * * * *